US006724903B2

(12) United States Patent
Niederdrank

(10) Patent No.: US 6,724,903 B2
(45) Date of Patent: Apr. 20, 2004

(54) MICROPHONE ARRANGEMENT IN A HEARING AID TO BE WORN BEHIND THE EAR

(75) Inventor: Torsten Niederdrank, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 0 days.

(21) Appl. No.: 10/185,311

(22) Filed: Jun. 28, 2002

(65) Prior Publication Data

US 2003/0002701 A1 Jan. 2, 2003

(30) Foreign Application Priority Data

Jun. 28, 2001 (DE) ..... 101 31 214

(51) Int. Cl.[7] ..... H04R 25/00
(52) U.S. Cl. ..... 381/330; 381/313
(58) Field of Search ..... 381/313, 322, 381/327, 328, 330, 355, 356, 357, 358, 381

(56) References Cited

U.S. PATENT DOCUMENTS 5,003,606 A 3/1991 Bordewijk

FOREIGN PATENT DOCUMENTS

| | | |
|---|---|---|
| DE | 296 21 611 | 4/1997 |
| DE | 198 52 758 | 5/2001 |
| WO | WO 00/49836 | 8/2000 |

*Primary Examiner*—Huyen Le
(74) *Attorney, Agent, or Firm*—Schiff Hardin LLP

(57) ABSTRACT

In a microphone with a microphone housing for arrangement in a hearing aid to be worn behind the ear having a hearing aid housing, respective sound entry nozzles with respective sound entry apertures are arranged at two opposite sides of the microphone housing. The sound entry nozzles discharge into a chamber at a side of the microphone membrane. The sound entry nozzles are introduced into the respective sound entry apertures in opposite sides of the hearing aid housing, and when the hearing aid is worn, the sound entry aperture of one sound entry nozzle is disposed approximately distally from the head and the sound entry aperture of the other sound entry nozzle is disposed approximately proximally relative to the head. The microphone is space-saving and is simple to arrange in the hearing aid.

4 Claims, 2 Drawing Sheets

MICROPHONE ARRANGEMENT IN A HEARING AID TO BE WORN BEHIND THE EAR

BACKGROUND OF THE INVENTION

1. Field of the Invention

The present invention is directed to a hearing aid to be worn behind the ear having a hearing aid housing, and a microphone that is arranged in the hearing aid housing and that has a microphone housing.

2. Description of the Prior Art

Particular attention is paid to miniaturization in the development of hearing aids. In particular, the microphones play an important part in modern hearing aids since a number of microphones often must be integrated in a hearing aid in the case of directional microphone arrangement. Moreover, the position of the microphones often is prescribed for acoustic reasons, so that the limits of miniaturization often are reached as a result of the arrangement of the microphones and the design of the hearing aides being prescribed.

Known microphones have a microphone body that is connected to a nozzle-shaped component for sound admission. This sound entry nozzle is introduced into a corresponding receptacle in the hearing aid housing. The sound entry nozzle—for acoustic and mechanical reasons—usually leads directly through the housing surface to the sound entry aperture in the hearing aid housing.

German Utility Model 296 21 611 discloses a microphone for an electrical hearing aid that is provided with a sound entry nozzle.

German Translation 689 14 083 discloses a hearing aid with whistling suppression. To this end, the hearing aid has a further microphone, in addition to a first microphone, that is sensitive only for near sound and is coupled to a second input of the amplifier. Both microphones are coupled to the allocated inputs of the amplifier that, given supply of the output signals of both microphones to the appertaining inputs of the amplifier, the amplifier delivers nearly no output signal insofar as the output signals of the two microphones are caused by near sound.

German PS 198 52 758 discloses a hearing aid device to be worn behind the ear that has a microphone system connected to an amplifier circuit. The pick-up characteristic of the microphone system can be modified by means of a carrier for the microphone system that is pivotable relative to the vertical and/or rotatable relative to the horizontal and is arranged in or at the hearing device, this carrier having at least one microphone and two sound entry apertures.

Further, WO 00/49836 discloses a microphone for arrangement in a hearing aid, the microphone having three sound entry apertures that are all arranged in a common plane.

SUMMARY OF THE INVENTION

An object of the present invention is to improve the arrangement of a microphone with a microphone housing in a hearing aid to be worn behind the ear.

In a hearing aid to be worn behind the ear that has a hearing aid housing and a microphone arranged in the hearing aid housing, the microphone having a microphone housing, this object is achieved by the hearing aid housing having a respective sound entry apertures in opposite sides with respective sound entry nozzles, each with a sound entry aperture, arranged at two opposite sides of the microphone housing. The sound entry nozzles project into the sound entry apertures of the hearing aid housing, and, when the hearing aid is worn, the sound entry aperture of one sound entry nozzle is arranged approximately distally from the head of the hearing aid wearer and the sound entry aperture of the other sound entry nozzle is approximately arranged proximally relative to the head of the hearing aid wearer.

In a simple way, the hearing aid fashioned according to the invention enables the arrangement of lateral sound entry apertures in the hearing aid housing. Due to the small structure of the microphone as well as the elimination of additional sound conducting channels between the microphone and the sound entry aperture in the hearing aid housing, the accommodation of the microphone is possible in the middle as well as at an end within the hearing aid housing. In contrast to microphones previously employed, which have a one-sided admission of the acoustic signals into the frontal volume of the microphone lying directly at the microphone membrane, the inventive arrangement has a microphone with two sound entry nozzles. These are arranged at two opposite microphone sides and likewise provide the incoming acoustic signals with access to the frontal microphone volume.

Microphones with sound entry nozzles lying opposite one another can be integrated in a simple way in the hearing aid housing and allow double-sided sound entry with minimal space requirements. The total cross-section of the sound entry area required for physical reasons thus is distributed between the two sound entry nozzles (i.e., they each provide a portion of that area), as a result of which these nozzles can be made comparatively small. The acoustic channels between the lateral sound entry apertures in the hearing aid housing and the microphone membrane are extremely short and are implemented in a simple way in the microphone of the invention, having an advantageous influence on the acoustic properties. Further, the sound entry nozzles in the microphone of the invention can simultaneously serve as structure for fastening the microphone in the hearing aid. Further fastening structure can be eliminated as a result. In the microphone of the invention, thus, acoustic as well as design rules are taken into consideration.

In a preferred embodiment of the invention, the sound entry nozzles of the microphone as well as the sound entry apertures are arranged in opposite sides of the hearing aid housing on a shared symmetry axis. As a result of the symmetrical structure of the microphone housing achieved in this way, the installation as well as the alignment in the hearing aid housing are simplified. Further, moisture or dirt entering through one sound entry aperture can emerge or, if necessary, be blown out through the opposite sound entry aperture.

As a result of the arrangement of a number of microphones in the hearing aid as well as a suitable electrical interconnection, a directional microphone system can be realized. All microphones in this system preferably are designed according to the invention. The simple, space-saving accommodation of a microphone of the invention in the housing of the hearing aid facilitates the accommodation of a number of such microphones within one microphone housing.

Another possibility for realizing a directional microphone is to modify an individual microphone of the invention so that it exhibits a directional effect. To this end, the microphone has several pairs of sound entry nozzles, with the sound entry nozzles in each pair arranged at two opposite sides of the microphone housing and discharging into a chamber at one side of a microphone membrane. The sound entry nozzles of each pair are introduced into respective sound entry apertures at opposite sides of the hearing aid housing. The sound entry aperture of one sound entry nozzle of a pair is arranged distally from the head and the sound entry aperture of the other sound entry nozzle of a pair is arranged approximately proximally relative to the head when the hearing aid is worn. In this way, a differential microphone that exhibits a directional characteristic can be formed with one microphone of the invention having at least two pairs of sound entry nozzles.

DESCRIPTION OF THE PREFERRED EMBODIMENTS

Figure 1:
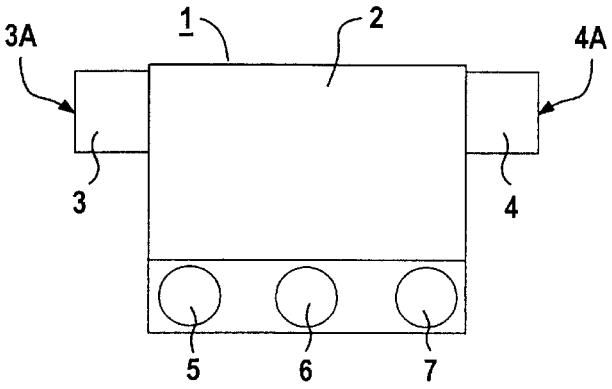
FIGS. 1 through 3 show three views of a microphone in accordance with the invention.

FIG. 1 shows an embodiment of the inventive microphone in plan view. The microphone 1 has a microphone housing 2 at which respective sound entry nozzles 3 and 4 are arranged at two opposite sides. The sound entry nozzles 3 and 4 form respective sound entry apertures 3A and 4A at their free ends and have respective opposite ends leading to a microphone chamber in the interior of the microphone 1. For the electrical connection of the microphone 1 to a hearing aid amplifier, the microphone 1 has three terminal contacts 5, 6 and 7.

Figure 2:
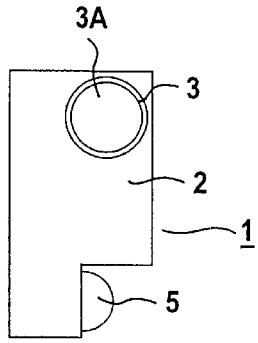

FIG. 2 shows the microphone in a side view. The sound entry nozzle 3 directed out of the plane of the drawing and having the sound entry aperture 3A is arranged at the housing 2. Further, the electrical terminal contact 5 can be seen.

Figure 3:
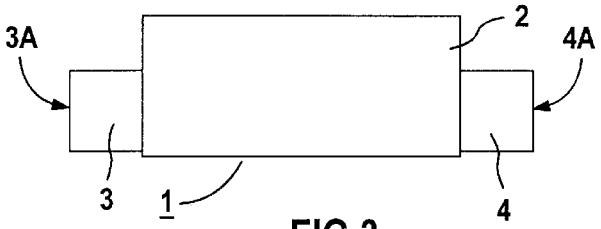

FIG. 3 shows an end face of the microphone 1. The housing 2 with the two sound entry nozzles 3 and 4 arranged at opposite sides can be seen.

Figure 4:
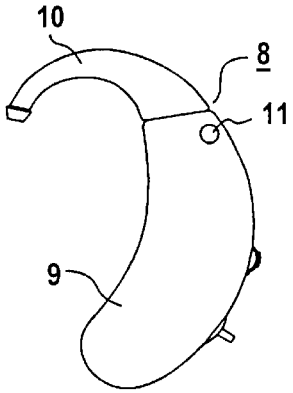
FIGS. 4 and 5 show side views of a hearing aid to be worn behind the ear provided for the incorporation of a microphone of the invention.
Figure 5:
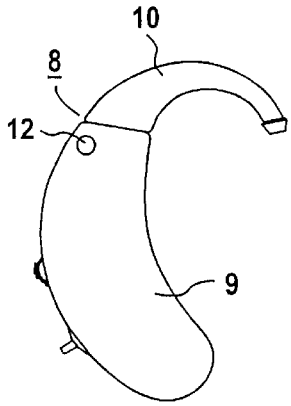

FIGS. 4 and 5 each show a side view of a hearing aid 8 to be worn behind the ear. The hearing aid 8 has a hearing aid housing 9 having an upper end at which a carrying hook 10 is disposed. At two opposite housing sides, the hearing aid housing 9 has a respective sound entry aperture 11 and 12 into which the sound entry nozzles 3 and 4 for the acceptance of the microphone according to the invention are respectively introduced. As a result of the space-saving arrangement of the microphone of the invention in the hearing housing 9, the sound entry apertures 11 and 12 can be positioned nearly arbitrarily at the two opposite sides of the hearing aid housing 9. Preferably, the sound entry apertures 11 and 12, and thus the sound entry nozzles 3 and 4 of the appertaining microphone, lie on a shared axis.

Figure 6:
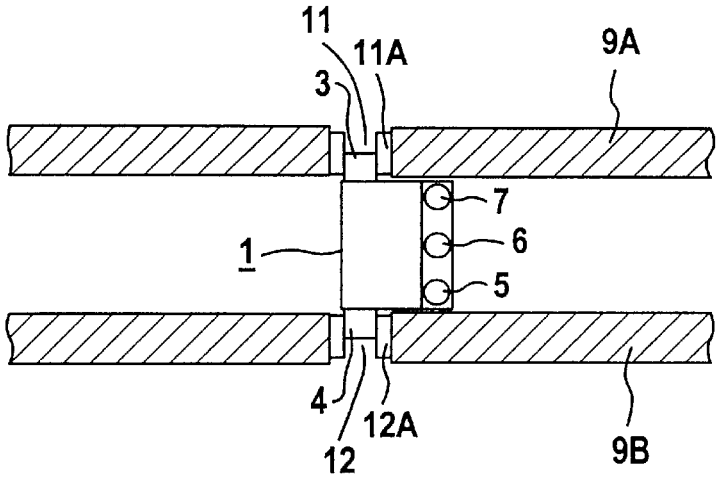
FIG. 6 shows a hearing aid to be worn behind the ear in section having a microphone arranged in conformity with the invention.

FIG. 6 shows a simplified illustration of a section through the hearing aid housing 9. Two opposite housing shells 9A and 9B respectively have sound entry apertures 11 and 12 formed by the two housing passages 11A and 12A. The respective sound entry nozzles 3 and 4 of the microphone project into the sound entry apertures 11 and 12. The microphone 1 thus is mounted at both sides at the sound entry nozzles 3 and 4 that are positively introduced into the two housing passages 11A and 12A, respectively. As a result of this arrangement, the microphone 1 is pivotably seated in the hearing aid housing 9. The aforementioned electrical terminal contacts 5, 6 and 7 of the microphone 1 also are shown. The space-saving accommodation of the microphone within the hearing aid housing can be seen from FIG. 6. The mounting of the microphone ensues by means of the two sound entry nozzles 3 and 4. This enables fast and simple assembly. Further, the extremely short sound conducting paths from the sound entry apertures 11 and 12 into the inside of the microphone 1 can be seen from FIG. 6. This has a positive influence on the acoustic properties of the hearing aid-microphone unit.

Figure 7:
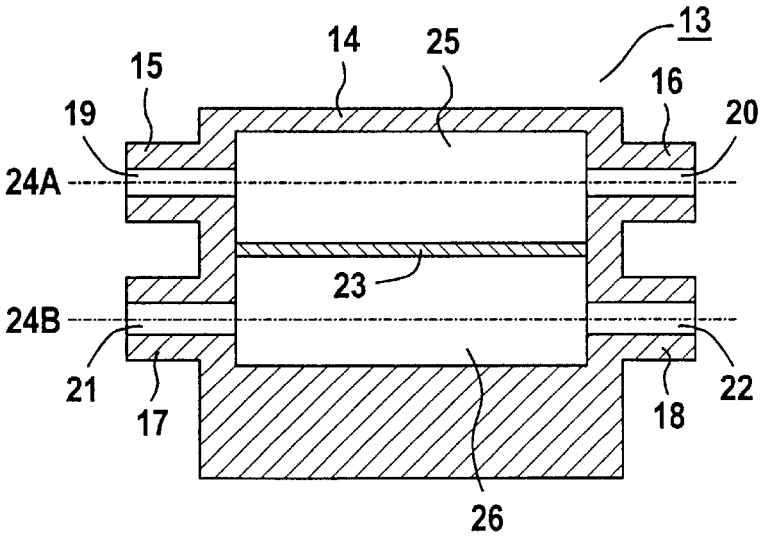
FIG. 7 shows an inventive microphone in cross-section.

FIG. 7 shows a schematic illustration of a microphone 13 in cross-section. The sound entry nozzle pair 15 and 16 as well as the sound entry nozzle pair 17 and 18 are attached at two opposite sides of the microphone housing 14. The sound entry nozzles 15 through 18 form sound entry apertures 19 through 22. The sound entry nozzles 15 and 16 enter at one side of the microphone membrane 23, and the sound entry nozzles 17 and 18 enter at the opposite side of the microphone membrane 23. As a result thereof, the microphone 13 is a differential microphone. As also can be seen from the drawing, the sound entry nozzle pair 15 and 16 are arranged along a shared symmetry line 24A and the sound entry nozzle pair 17 and 18 are arranged along a shared symmetry line 24B. It is thus possible that moisture or dirt which may enter through one sound entry aperture 19, 20, 21, 22 can in turn emerge or be blown out at the other side.

In summary, respective sound entry nozzles with respective sound entry apertures are arranged at two opposite sides of the microphone housing of a microphone for arrangement in a hearing aid to be worn behind the ear, which has a hearing aid housing. The sound entry nozzles discharge into a chamber at a side of the microphone membrane, and the sound entry nozzles are introduced into respective receptacles in opposite sides of the hearing aid housing. The sound entry aperture of one sound entry nozzle is arranged approximately distally from the head when the hearing aid is worn and the sound entry aperture of the other sound entry nozzle is arranged approximately proximally relative to the head. The microphone fashioned in this way is space-saving and can be arranged in the hearing aid in a simple way.

Although modifications and changes may be suggested by those skilled in the art, it is the intention of the inventor to embody within the patent warranted hereon all changes and modifications as reasonably and properly come within the scope of his contribution to the art.

I claim as my invention:

1. A behind-the-ear hearing aid comprising:

a hearing aid housing having two opposite lateral sides, each of said two opposite lateral sides having a laterally-facing sound entry aperture therein; and a microphone having a microphone housing disposed inside said hearing aid housing between said two opposite lateral sides of said hearing aid housing, said microphone housing having a pair of sound entry nozzles respectively projecting into said sound entry apertures in said hearing aid housing so that when said hearing aid is worn, one of said sound entry apertures for one of said sound entry nozzles is disposed facing toward a head of a hearing aid wearer, and the other of said sound entry apertures of the other of said sound entry nozzles is disposed farther from and facing away from the head of the hearing aid wearer.

2. A behind-the-ear hearing aid as claimed in claim 1 wherein said microphone comprises a plurality of pairs of sound entry nozzles, with the respective sound entry nozzles in each pair being disposed at opposite sides of said microphone housing.

3. A behind-the-ear hearing aid as claimed in claim 2 wherein said microphone has a microphone chamber with a membrane therein, and wherein the respective sound entry nozzles of one of said plurality of pairs discharge into said chamber at a first side of said microphone membrane, and the respective sound entry nozzles of another of said plurality of pairs discharge into said chamber at a second, opposite side of said microphone membrane.

4. A behind-the-ear hearing aid as claimed in claim 2 wherein each of said plurality of pairs of laterally-facing sound entry nozzles is introduced into a pair of sound entry apertures respectively in the opposite lateral sides of said hearing aid housing, with each pair of sound entry nozzles, and the respective apertures into which said sound entry nozzles are introduced, are disposed along a common symmetry axis.

* * * * *